United States Patent [19]

Lamadrid et al.

[11] 4,195,766

[45] Apr. 1, 1980

[54] LATCH ASSEMBLY FOR LATCHING PLATENS IN PLACE WITHIN A CENTRIFUGE DEVICE

[75] Inventors: Rene Lamadrid, Bethesda; Albert Kitchenham, Laurel, both of Md.; C. Michael Jennings, Reston, Va.

[73] Assignee: Baxter Travenol Laboratories, Inc., Deerfield, Ill.

[21] Appl. No.: 29,742

[22] Filed: Apr. 13, 1979

[51] Int. Cl.[2] ..... B04M 9/12

[52] U.S. Cl. ..... 233/26

[58] Field of Search ..... 233/26; 366/213, 214, 366/215, 217, 208, 209, 210, 211

[56] References Cited

U.S. PATENT DOCUMENTS

| | | | |
|---|---|---|---|
| 3,163,404 | 12/1964 | Kraft | 233/26 |
| 3,497,183 | 2/1970 | Corey | 366/214 |
| 3,891,140 | 6/1975 | Ayres | 233/26 |

FOREIGN PATENT DOCUMENTS

| | | | |
|---|---|---|---|
| 576395 | 5/1959 | Canada | 233/26 |

*Primary Examiner*—Robert W. Jenkins

*Attorney, Agent, or Firm*—Henry W. Collins; Paul Flattery; Thomas R. Vigil

[57] ABSTRACT

The latch assembly is utilized in a centrifuge device wherein a receptacle is received and held between first and second platens which have elastomeric linings and which are held generally upright in respective inner and outer parallel planes spaced radially outwardly from a vertical axis of rotation of the centrifuge device. The first platen is situated in the inner plane and the second platen is fixed in the outer plane. The first platen is mounted for pivotal movement about a generally horizontal axis extending along a lower edge of the platens. The latch assembly includes first and second keeper members fixed respectively to adjacent opposite sides of the second platen. The latch assembly further includes a shaft journalled to the outer surface of the first platen. First and second latch mounting members are fixed, respectively, to opposite ends of the shaft. A handle is fixed to and extends from the first latch mounting member and each of the latch mounting members has a pin extending therefrom, each pin bein adapted to be received in respective ones of the first and second keeper members. The construction, dimensions and arrangement of the various parts of the latch assembly are such that when the pins are moved into the keeper members, each moves along an arc which would normally intersect the associated keeper member such that an overcenter toggle latching action is obtained as the pins engage and are moved into the keeper members with the elastomeric linings being compressed to allow the overcenter latching action.

2 Claims, 7 Drawing Figures

FIG. 1
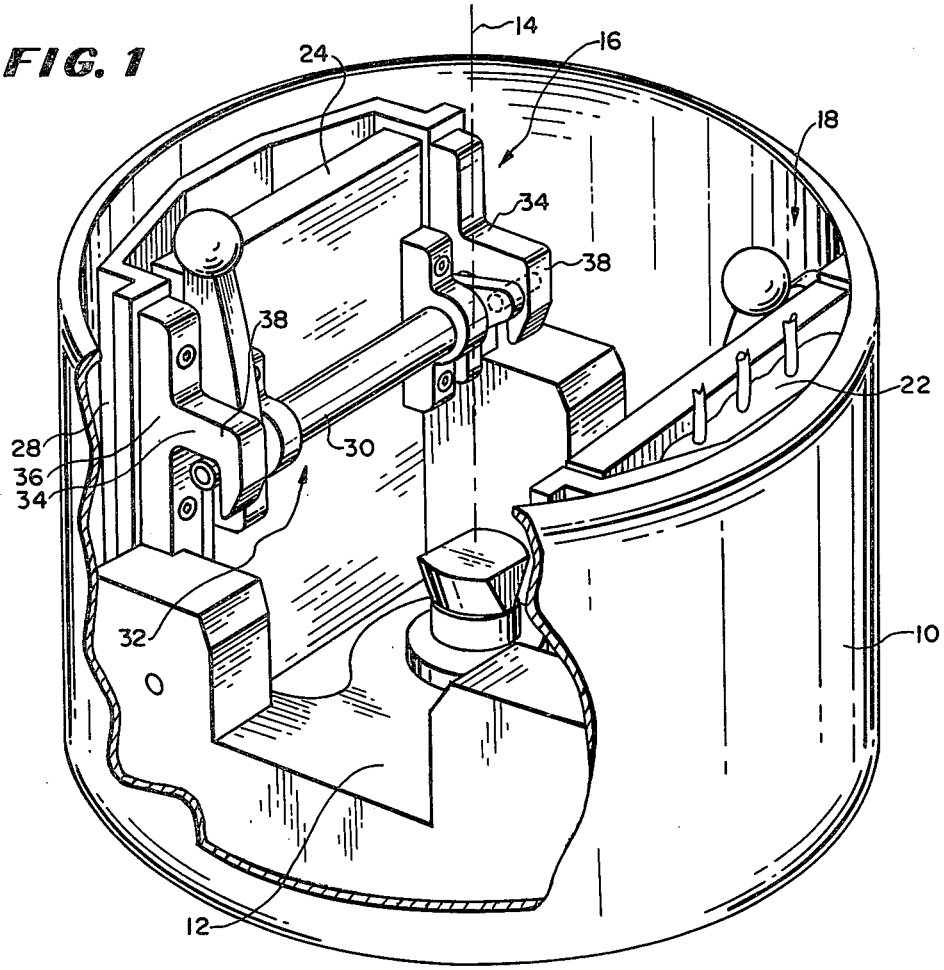
FIG. 2
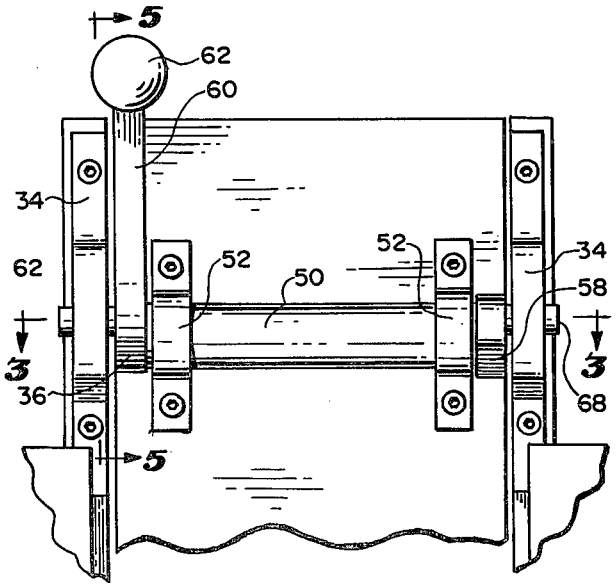
FIG. 3
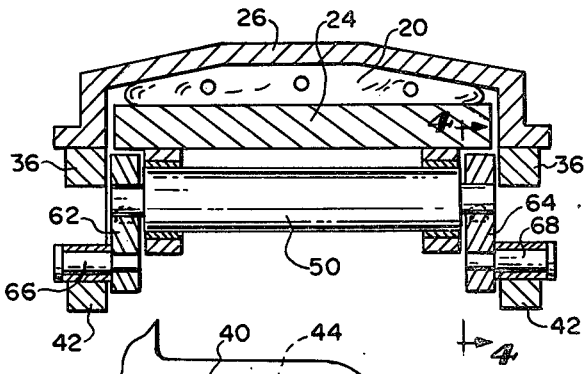
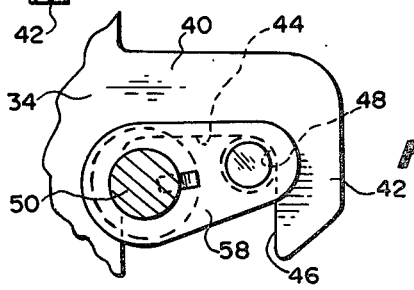
FIG. 4

LATCH ASSEMBLY FOR LATCHING PLATENS IN PLACE WITHIN A CENTRIFUGE DEVICE

BACKGROUND OF THE INVENTION

1. Field of the Invention

The field of the invention is a latch assembly for latching a receptable between first and second platens in a centrifuge device such as found in a centrifugal liquid processing apparatus.

2. Description of the Prior Art

Heretofore various means such as bolts and clamps were utilized for holding a receptacle between two platens in a centrifugal liquid processing apparatus. Further details of the construction and operation of such a centrifugal liquid processing apparatus are disclosed in application Ser. No. 843,296 filed Oct. 18, 1977, now U.S. Pat. No. 4,146,172, entitled: CENTRIFUGAL LIQUID PROCESSING APPARATUS and application Ser. No. 843,222 filed Oct. 18, 1977 entitled: METHOD AND APPARATUS FOR PROCESSING BLOOD, the disclosures of which are incorporated herein by reference.

The previously utilized means, such as clamps and bolts, for clamping two platens together with a receptacle therebetween and with elastomeric linings between the inner side of each platen and the receptacle have not always provided a good clamping of the platens inasmuch as the vibrations incurred during operation of the centrifuge device cause the clamps and bolts to loosen. Also, once a quantity of liquid had been processed in the apparatus, the clamps and bolts took some time to release in order to remove the receptacle from the platens.

As will be explained in greater detail hereinafter, the latch assembly of the present invention differs from the previously proposed clamping means for clamping two platens together in a centrifuge device by providing a latch assembly with an overcenter toggle action which provides a simple mechanism for latching and unlatching the platens together with the receptacle held therebetween and which is constructed, arranged and oriented so that centrifugal forces on the latch assembly will cause the platens to stay latched even when vibrations are incurred by the centrifuge device.

SUMMARY OF THE INVENTION

According to the invention there is provided in a centrifuge device wherein a receptacle is received and held between first and second platens which have elastomeric linings and which are held in generally upright respective inner and outer parallel planes spaced radially outwardly from a vertical axis of rotation of the device with the first platen being situated in the inner plane and the second platen being fixed in the outer plane, the improvement comprising a latch assembly including first and second keeper members fixed respectively adjacent opposite sides of the second platen, the first platen being mounted for pivotal movement about a generally horizontal axis extending along a lower edge thereof, and said latch assembly further including a shaft journalled to the outer surface of the first platen, which surface faces radially inwardly toward the axis of rotation of the centrifuge device, first and second latch mounting members fixed, respectively, to opposite ends of said shaft, a handle fixed to and extending from said first latch mounting member, and first and second latch forming members fixed, respectively, to said first and second latch mounting members and arranged to be received in said first and second keeper members upon movement of said handle and the first platen upwardly and radially outwardly from the axis against the second platen.

BRIEF DESCRIPTION OF THE DRAWINGS

FIG. 1 is a perspective view with portions broken away of a drum utilized in a centrifuge device, and shows a rotor mounting platens which are latched by the latch assembly of the present invention.

FIG. 2 is a vertical sectional view of the latch assembly of the present invention taken along line 2—2 of FIG. 1.

FIG. 3 is a sectional view taken along line 3—3 of FIG. 2.

FIG. 4 is a sectional view taken along line 4—4 of FIG. 3.

DESCRIPTION OF THE PREFERRED EMBODIMENT

Figure 5:
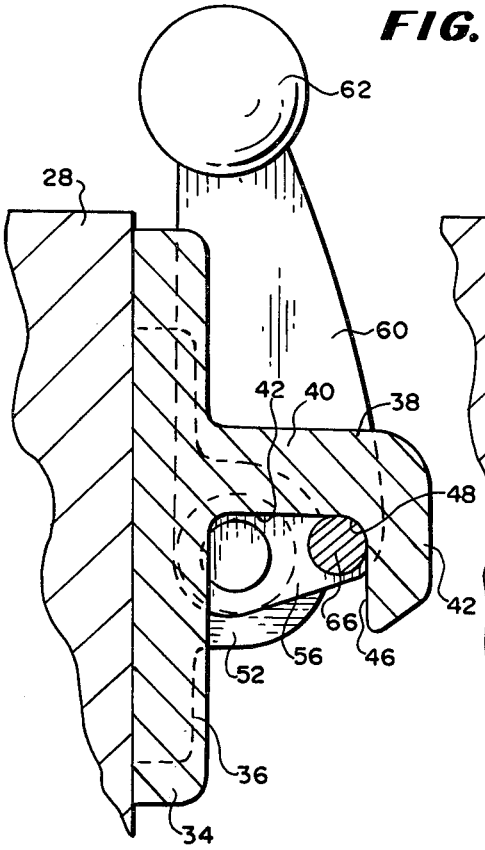
FIG. 5 is a vertical sectional view taken along line 5—5 of FIG. 2.

Referring to the drawings in greater detail, there is illustrated in FIG. 1, a drum 10 and a rotor 12 of a centrifuge device utilized in a centrifugal liquid processing apparatus which can be of the type disclosed in application Ser. No. 843,296 filed Oct. 18, 1977 entitled: CENTRIFUGAL LIQUID PROCESSING APPARATUS and application Ser. No. 843,222 filed Oct. 18, 1977 entitled: METHOD AND APPARATUS FOR PROCESSING BLOOD, the disclosures of which are incorporated herein by reference.

The rotor 12 is arranged for rotation about a vertical axis 14 and has mounted thereon in generally upright positions two platen assemblies 16 and 18 each of which is spaced outwardly from the axis 14. Each platen assembly 16 and 18 is adapted to hold a receptacle 20 (FIG. 3) or 22 which is typically defined by plastic bags. In the use of the centrifuge device, liquids to be centrifuged are placed in the receptacles 20 and 22 held within the platen assemblies mounted on the rotor 12 and the rotor 12 is rotated. Since the platen assemblies 16 and 18 are substantially identical, only the platen assembly 16 will be hereinafter described in detail.

As shown in FIGS. 1 and 3, the platen assembly 16 includes a first or inner platen 24 which is located in a first upright plane and a second or outer platen 26 which is located generally in a second upright plane spaced outwardly from the axis of rotation of the rotor. Although not shown, it is to be understood that each of the platens 24 and 26 has an elastomeric lining to permit compression of the receptacle 20 located between the platens 24 and 26.

As shown in FIGS. 1 and 3, the first platen 24 is generally planar and is mounted for pivotal movement about a horizontal axis extending along the lower edge of the platen. The pivot mounting is hidden from view in the Figures. The second platen 26 has a generally U shaped cross section so that the first platen 24 can fit within the second platen 26 for holding a receptacle 20 therebetween. The second platen 26 is also provided with flanges 28 and 29.

According to the teachings of the present invention, each platen assembly 16 (18) includes a latch assembly 32. As shown, the latch assembly 32 includes first and second keeper members 34 each of which is mounted to one of the flanges 28 and 29. Each of the keeper members 34 includes a base portion 36 fixed to one of the flanges 28,29 and a hook or catch portion 38 extending outwardly from the base portion 36. The hook portion 38 has a generally L shaped configuration with a first leg 40 thereof extending outwardly from the base portion 36 and a second leg 42 extending generally vertically downwardly from the first leg 40. The first leg 40 has an undersurface 44 and the leg 42 has an inner surface 46. The surfaces 44 and 46 meet at a rounded corner 48.

The latch assembly 32 further includes a shaft 50 which is journalled by two journal members 52 to an outer surface 54 of the first platen 24. On each end of the shaft 50 is located a latch mounting member 56, 58. The latch mounting member 56 has an elongate portion 60 extending therefrom with a ball 62 at the end thereof forming a handle. The other latch mounting member 58 is smaller as shown in FIGS. 1 and 4. Extending outwardly from the outer side 62,64 of each latch mounting member 56 and 58 is a stub pin 66 and 68 each of which is designed to engage the inner facing surface 46 of the second leg 42. Each pin 66, 68 forms a latch member which is adapted to be received in the rounded inner corner 48 of each keeper member 34.

Figure 6:
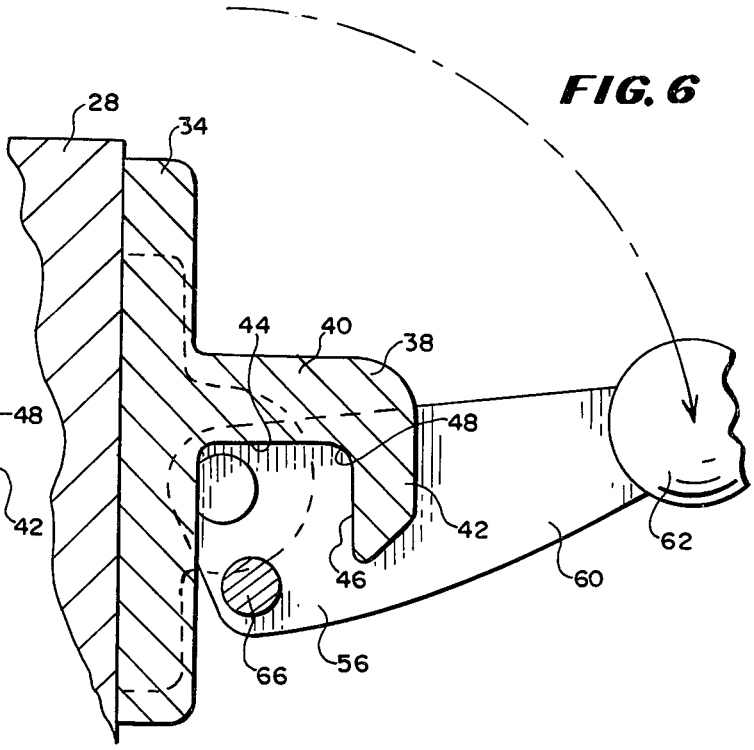
FIG. 6 is a sectional view similar to FIG. 5 and shows the handle of the latch assembly released from a keeper for unlatching the platens.
Figure 7:
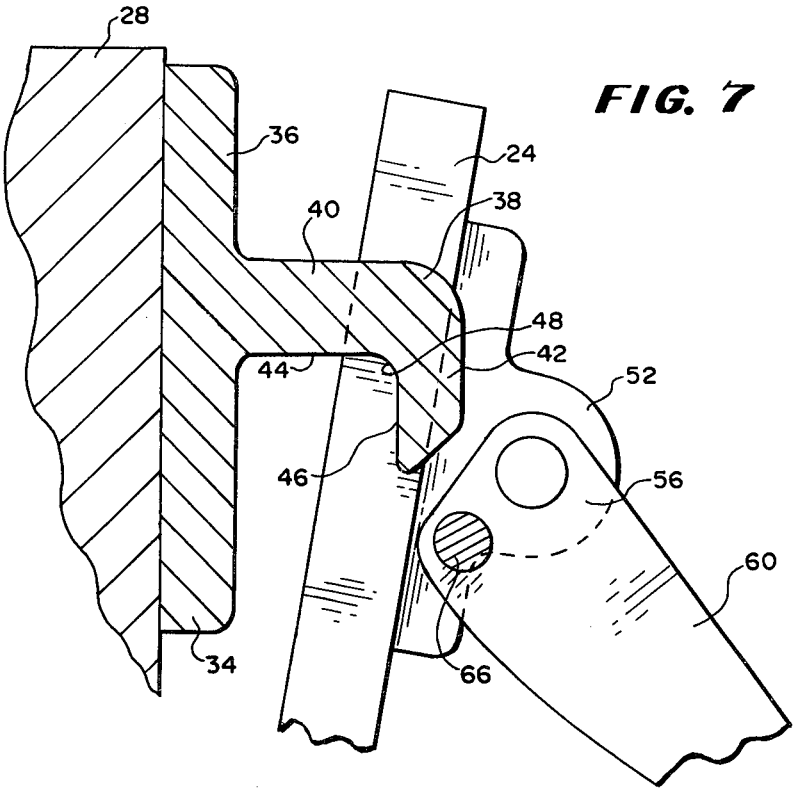
FIG. 7 is a sectional view similar to FIG. 6 and shows the handle in a lowered position and the inner platen pulled away from the outer platen.

As best shown in FIGS. 5, 6 and 7, the axis of the shaft 50 is located beneath the plane of the downwardly facing surface 44 of the first leg 40 of each keeper member 34 and the axis of the pins is coaxial and spaced from the axis of the shaft 50. It will be apparent from FIGS. 4, 5 and 6 that when the first platen 24 is pulled upwardly such as by gripping the top of the first platen 24 by hand and brought to an upright position as shown in FIGS. 1, 2 and 3, the handle 60 is then rotated from its lower position shown in FIG. 7 upwardly to the position shown in FIG. 6 to the position shown in FIG. 5. During the movement, the pins 66, 68 will rotate through an arc which would normally intersect the vertically inwardly facing surface 46 of the keeper members 34. However, in view of the resiliency of the elastomeric lining of the platens 24 and 26, the shaft 50 and the first or inner platen 24 will move inwardly compressing the elastomeric lining which the pins 66 and 68 ride on the inner surface 46 until each pin 66, 68 reaches the respective corner 48. While this occurs, the axis of the shaft will move slightly outwardly relative to the axis 14 as the elastomeric lining is compressed and then slightly inwardly relative to the axis 14 to the position shown in FIGS. 4 and 5 where each pin 66, 68 is located in an overcenter toggle locking position in the respective corner 48.

With the latch assembly 32 of the present invention constructed, dimensioned and arranged in the manner described above and illustrated in the drawings, it will be apparent that when it is desired to open either platen assembly 16 or 18, the handle 60 is moved downwardly compressing the elastomeric lining slightly to unsnap or untoggle the pins 66, 68 from the keeper members 34. Then, with the handle 60 hanging downwardly, the inner platen 24 can be grasped at the top thereof and moved inwardly and downwardly relative to the axis 14 away from the outer platen 26 to insert or remove a receptacle 20,22—a plastic bag—from the platen assembly 16 or 18.

When it is desired to clamp the platens 24 and 26 together with a receptacle 20 or 22 therebetween, a receptacle 20 or 22, namely a plastic bag, is inserted between the platens 24, 26 and the inner platen 24 is gripped by hand at the upper edge thereof and pulled upwardly into its upright position. Then, the handle 60 is moved from its position shown in FIG. 7 upwardly to the position shown in FIGS. 6 and 5 to bring the pins 66 and 68 into the keeper members 34 with an overcenter toggle action occurring as the pins 66, 68 move into the corner 48.

From the foregoing description it will be apparent that the latch assembly 32 of the present invention has a number of advantages, some of which have been described above and others of which are inherent in the invention. Specifically, by having an overcenter toggle locking action in the latch assembly 32, a simple and effective means is provided for clamping the inner platen 24 to the outer platen 26.

Also, if any vibrations are incurred in the operation of the centrifuge device, the centrifugal force on the handle 60 and on the inner platen 24 is such as to urge the pins 66, 68 toward the corner 48 of each keeper member 34 to maintain the platens 24 and 26 to latched together. Furthermore, when it is desired to open or close the platen assembly, this can be simply and easily accomplished merely by moving the handle 60 upwardly or downwardly as described above so that the plastic bag defining the receptacle 20 or 22 can be easily inserted or removed from the platen assembly 16 or 18.

It will be apparent from the foregoing description that obvious modifications and variations can be made to the latch assembly 32 of the present invention without departing from the teachings of the invention and accordingly the scope of the invention is only to be limited as necessitated by the accompanying claims.

We claim:

1. In a centrifuge device wherein a receptacle is received and held between first and second platens which have elastomeric linings and which are held in generally upright respective inner and outer parallel planes spaced radially outwardly from a vertical axis of rotation of the device with the first platen being situated in the inner plane and the second platen being fixed in the outer plane, the improvement comprising a latch assembly including first and second keeper members fixed respectively adjacent opposite sides of the second platen, the first platen being mounted for pivotal movement about a generally horizontal axis extending along a lower edge thereof, and said latch assembly further including a shaft journalled to the outer surface of the first platen, which surface faces radially inwardly toward the axis of the rotation of the centrifuge device, first and second latch mounting members fixed, respectively, to opposite ends of said shaft, a handle fixed to and extending from said first latch mounting member, and first and second latch forming members fixed, respectively, to said first and second latch mounting members and arranged to be received in said first and second keeper members upon movement of said handle and the first platen upwardly and radially outwardly from the axis against the second platen.

2. The latch assembly according to claim 1 wherein said latch forming members are stub pins coaxially mounted, respectively, on said latch mounting members and on an axis parallel to the axis of said shaft, and each of said keeper members having a base and a generally L shaped formation extending from said base and comprising one leg which extends generally horizontally and another leg which extends generally downwardly and which has a catch surface facing toward said base radially outwardly relative to the axis, said stub pins being moved into said keeper along an arc which normally would intersect said keeper surface to cause an over center toggle latching action as the stub pins are received in said keeper members and the elastomeric linings are compressed.

* * * * *